US005888019A

United States Patent [19]

Quastad

[11] Patent Number: 5,888,019

[45] Date of Patent: Mar. 30, 1999

[54] WALKING HOIST

[76] Inventor: Donald D. Quastad, 11951 Pasture Rd., Spirit Lake, Iowa 51360

[21] Appl. No.: 918,014

[22] Filed: Aug. 25, 1997

[51] Int. Cl.[6] ..... B63C 3/06; B63C 1/00

[52] U.S. Cl. ..... 405/3; 114/44; 405/7

[58] Field of Search ..... 405/1, 3, 7, 202; 114/44–48; 414/667, 668

[56] References Cited

U.S. PATENT DOCUMENTS

| | | | |
|---|---|---|---|
| 1,627,426 | 5/1927 | Briggs . | |
| 2,012,090 | 8/1935 | Straussler | 280/150 |
| 2,862,567 | 12/1958 | Dull | 180/1 |
| 2,892,593 | 6/1959 | Smeltzer | 239/177 |
| 2,996,303 | 8/1961 | Peltier | 280/1 |
| 3,150,733 | 9/1964 | Goebel | 180/8 |
| 3,612,201 | 10/1971 | Smith | 405/210 X |
| 3,942,627 | 3/1976 | Guigan | 198/219 |
| 3,945,450 | 3/1976 | Wilson et al. | 180/8 |
| 4,288,177 | 9/1981 | Schoonmade | 405/201 X |
| 5,184,914 | 2/1993 | Basta | 405/3 |
| 5,226,746 | 7/1993 | Johnson | 405/1 |
| 5,374,156 | 12/1994 | Simpson et al. | 414/667 |
| 5,485,798 | 1/1996 | Samoian et al. | 114/44 |
| 5,558,034 | 9/1996 | Hodapp | 405/3 X |
| 5,562,362 | 10/1996 | Vezner | 405/3 |
| 5,687,663 | 11/1997 | Wahlstrand | 405/3 X |

*Primary Examiner*—Dennis L. Taylor
*Attorney, Agent, or Firm*—Zarley, McKee, Thomte, Voorhees & Sease

[57] ABSTRACT

A walking hoist has a pair of elongated parallel laterally spaced side members with opposite ends. A downwardly extending leg with upper and lower ends is rigidly secured to the ends of each side member. A pair of U-shaped crank members are rotatably secured to and extend between adjacent ends of the side members. The U-shaped cranks each have a bearing member secured to the upper ends of the legs. The crank arms are secured to the bearings and extend radially therefrom in a parallel direction and terminate in an outer end. A horizontal shaft extends between pairs of said crank arms at each end of the legs of the side members. The crank arms are longer than the legs. A circular drive disk is rigidly and operatively secured to the lower ends of the crank arms adjacent the opposite ends of at least one of the side members. A rotational drive assembly is operatively connected to the drive disk to rotate the drive disk in unison in the same direction. A load supporting frame extends upwardly between the horizontal shafts of the cranks and is rotatably secured to the horizontal shafts.

11 Claims, 5 Drawing Sheets

WALKING HOIST

BACKGROUND OF THE INVENTION

In northern climates, it is necessary to take docks and boat hoists out of the water on lakes and the like to avoid the adverse affects of the frozen water during the winter season. The removal of this equipment in the fall and the replacement thereof in the spring is a difficult, expensive and time consuming procedure.

It is therefore a principal object of this invention to provide a walking hoist capable of supporting a dock or hoist, that when powered, can be mobile to move into or out of the water upon command.

A further object of this invention is to provide a walking hoist that can be easily moved upwardly and downwardly along steep slopes.

A still further object of this invention is to provide a walking hoist that will easily operate on terrain or in water.

A still further object of the invention is to provide a walking hoist that is useful in raising or lowering objects even when not in a walking mode.

These and other objects will be apparent to those skilled in the art.

SUMMARY OF THE INVENTION

The walking hoist of this invention has a pair of elongated parallel laterally spaced side members with opposite ends. A downwardly extending leg with upper and lower ends is rigidly secured to the ends of each side member. A pair of U-shaped crank members are rotatably secured to and extend between adjacent ends of the side members.

The U-shaped cranks each have a bearing member secured to the upper ends of the legs. The crank arms secured to the bearings and extend radially therefrom in a parallel direction and terminate in an outer end. A horizontal shaft extends between pairs of said crank arms at each of the legs of the side members. The crank arms are longer than the legs.

A circular drive disk is rigidly and operatively secured to the lower ends of the crank arms adjacent the opposite ends of at least one of the side members. A rotational drive assembly is operatively connected to the drive disk to rotate the drive disk in unison in the same direction.

A loud supporting frame extends upwardly between the horizontal shafts of the cranks and is rotatably secured to the horizontal shafts.

DESCRIPTION OF THE PREFERRED EMBODIMENT

Figure 1:
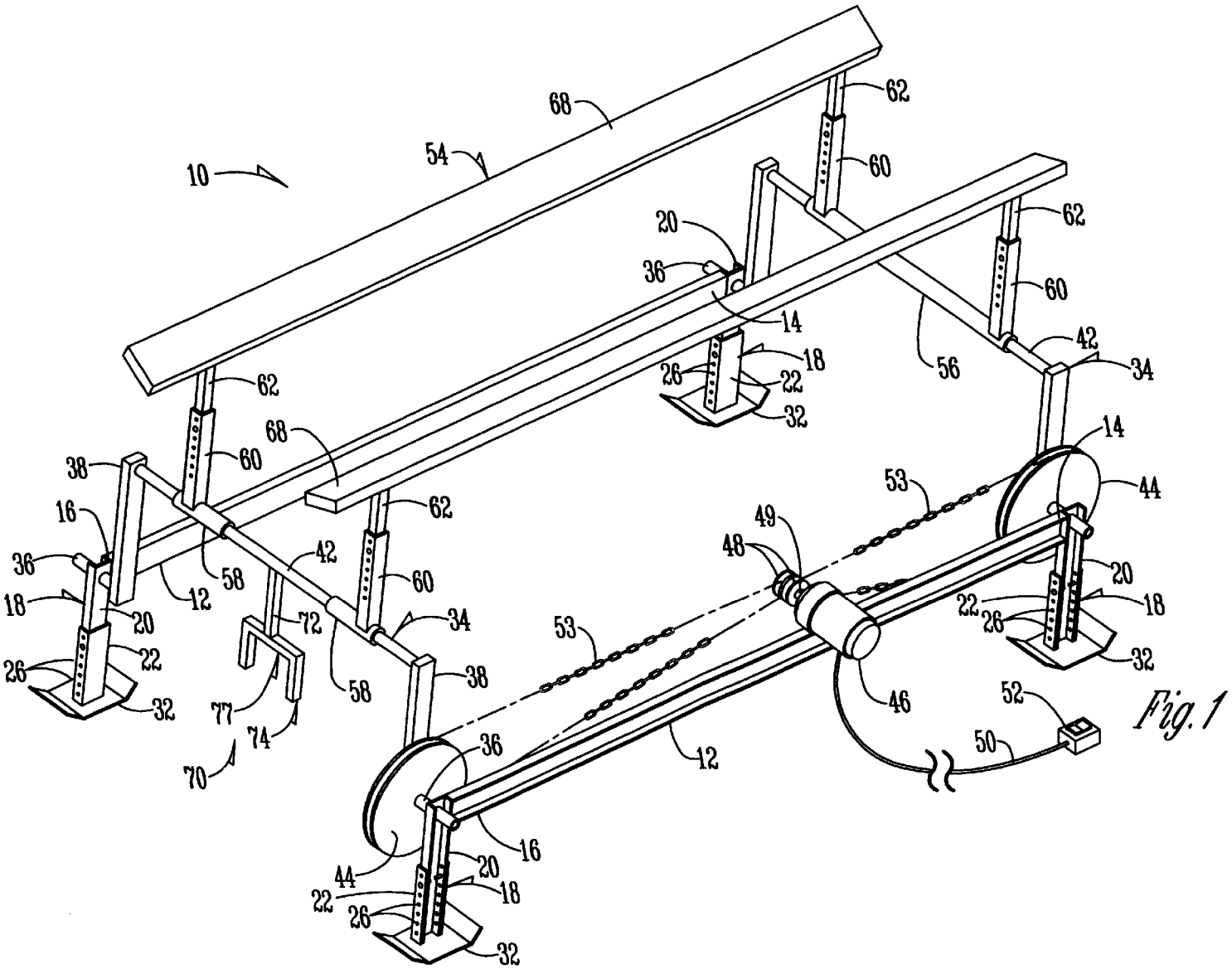
FIG. 1 is a perspective view of the walking hoist of this invention.

The numeral 10 designates the walking hoist of this invention. Side members 12 have opposite ends 14 and 16. Vertically disposed legs (FIG. 8) are comprised of an upper portion 20 and a lower portion 22. The portions 20 and 22 are adjustably interconnected by pin 24 which can extend through registering apertures 26. The legs 18 have upper ends 28 and lower ends 30. A flat supporting plate is rigidly secured to the lower end of portions 22.

Figure 8:
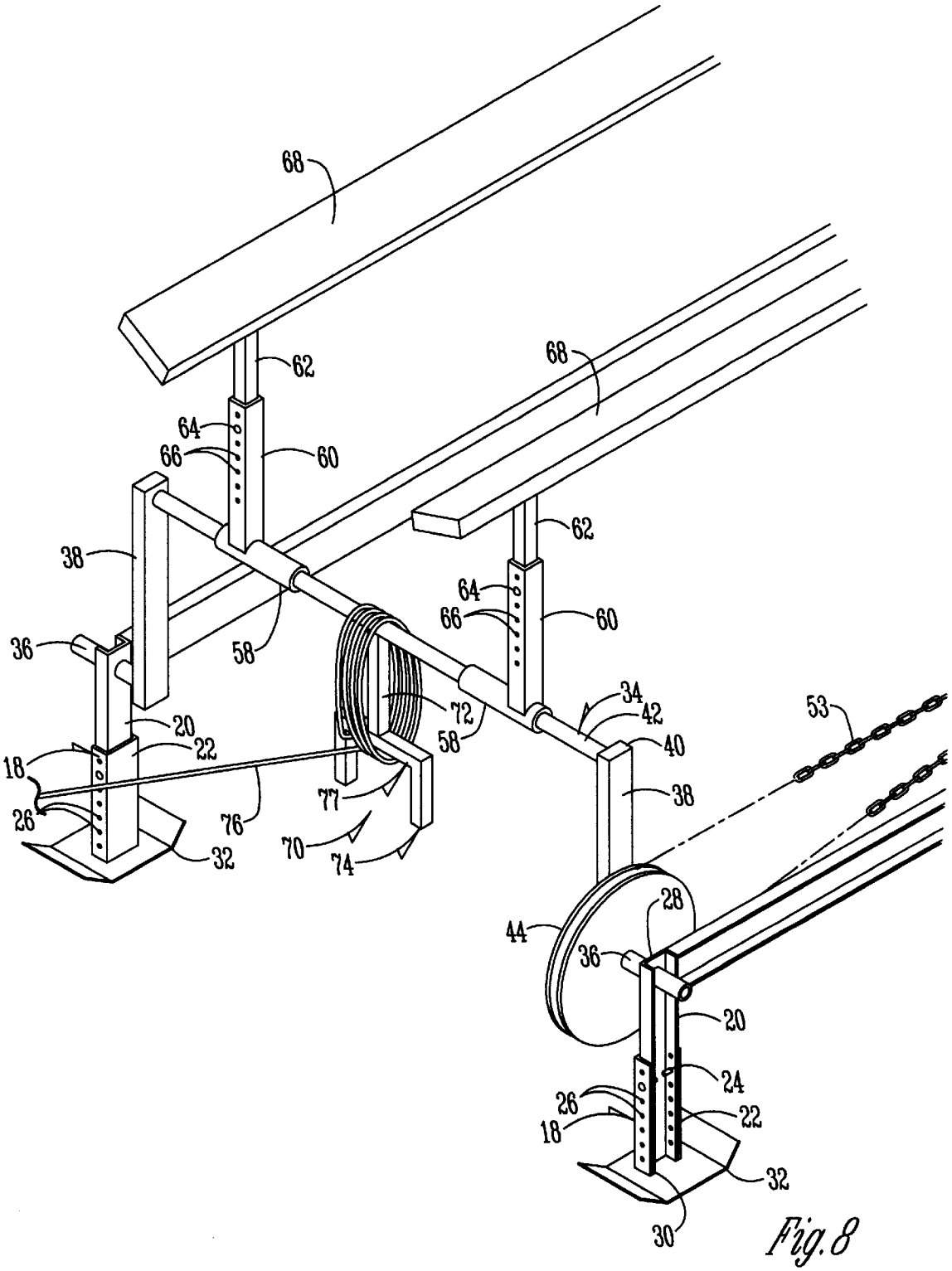
FIG. 8 is an exploded partial perspective view of the device of FIG. 1 showing the device connected to an anchored cable.

Cranks 34, as best shown in FIGS. 1 and 8, are rotatably secured to the upper ends of legs 18 by means of horizontal shafts 36 (FIG. 8). The cranks 34 are comprised of crank arms 38 which are secured by one of their ends to shafts 36 and which extend rigidly outwardly therefrom. Arms 38 terminate in outer ends 40 which are interconnected by horizontal shafts 42 which extend laterally between pairs of crank arms 38.

A drive disk 44 is rigidly secured to the shafts 36 at opposite ends of at least one of the side members 12 as best shown in FIG. 1. An electric motor 46 is mounted on the side member 12 between the disk 44 in any convenient way. If the motor is not sealed against moisture, the motor can be elevated above the top of the member 12 upon which it is secured to prevent the motor from ever becoming emersed in water. A pair of drive pulleys 48 are mounted to the output shaft 49. An electric cable 50 extends from the motor 46 and is connected to a source of electrical power (not shown). A suitable control switch 52 is imposed within cable 50. Any suitable means can be used to elevate the control switch 52 above the water level in the environment in which the device is to be operated. Chains 53 extend from each of the pulleys 48 to one of the drive disks 44 at the end of the member 12 upon which the motor is mounted (FIG. 1). The pulleys 48 and the drive disk 44 have an outer perimeter configuration compatible with the configuration of the chains 53 so that the rotation of the pulleys 48 will cause the disks 44 to be rotated in an identical manner. The switch 52 is adapted to reverse the polarity of motor 46 so that the output shaft 49 thereof can be rotated in either a clockwise or a counter clockwise direction.

A load supporting frame 54 (FIG. 1) of rigid construction is mounted by its ends on the horizontal shafts 42 of each of the cranks 34. A hollow shaft 56 is rotatably mounted on one of the horizontal shafts 42, and separate hollow shaft segments 58 are mounted on the other horizontal shaft 42 (FIG. 1). Upstanding posts 60 which are hollow and of square configuration are rigidly secured by their lower ends to the hollow shaft 56 and the shaft segments 58. Post segments 62 are telescopically mounted within the post 60 and are selectively held in position within the posts 60 by means of pin 64 which extends through registering apertures 66 within the members 60 and 62 (FIG. 8). Elongated beams 68 are secured to the upper ends of post segment 62 and are preferably tilted downwardly and inwardly to accommodate the shape of the hull of boat 69. By reason of the rigid connections between beams 68 and post segment 62, and between post segment 62 and upstanding post 60, and between upstanding post 60 and hollow shaft 56 and shafts 58, the load supporting frame 54 and beam 68 are always maintained in a substantially horizontal position as frame 54 moves upwardly and downwardly as cranks 34 are rotated, all to be explained in more detail hereafter.

Figure 5:
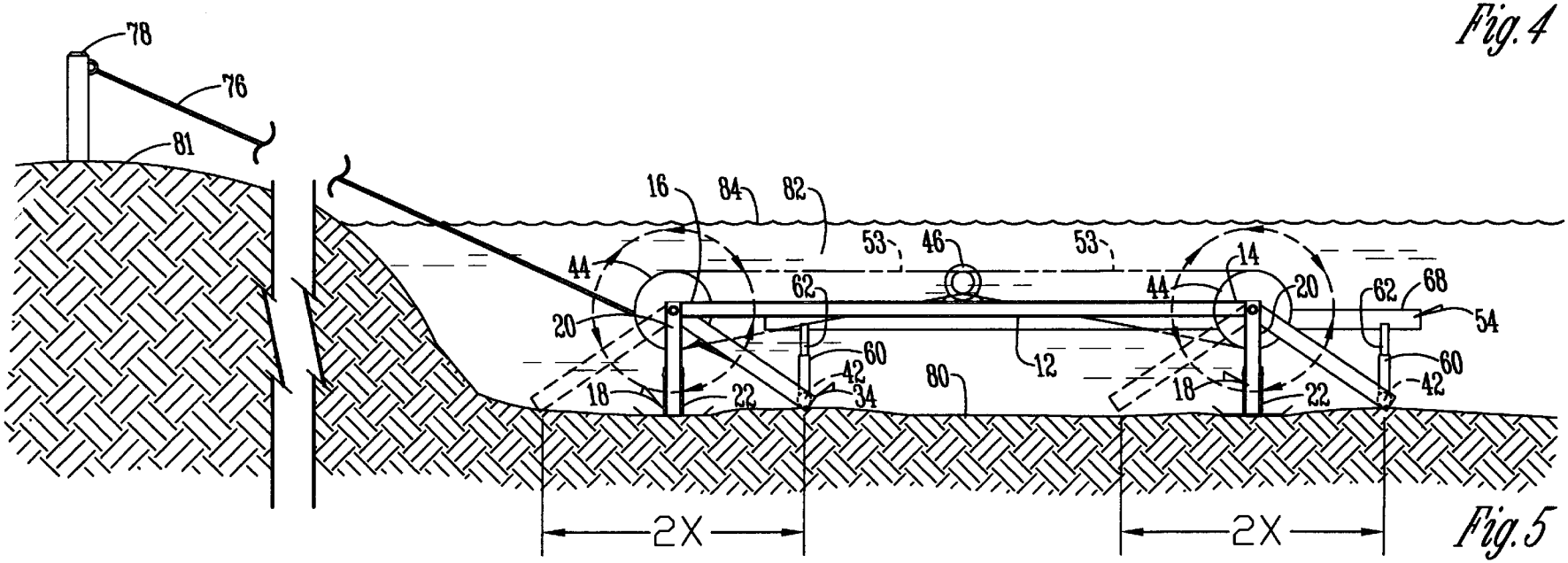
FIG. 5 is a view similar to FIG. 4 but shows how an anchoring cable can be utilized to move the apparatus on a steep bank which cannot be negotiated by the normal structure of the device.

A drive yoke 70 (FIG. 8) is rigidly secured to the shaft 42 in between shaft segments 58 (FIG. 1). The yoke 70 is comprised of an arm 72 which is welded or otherwise secured by one of its ends to the center of shaft 42 and extends radially therefrom. To the other end of arm 72 is secured a U-shaped bracket 74. A cable 76 has one of its ends secured to the bite 77 of the yoke 70. The opposite end of cable 76 is secured to another post 78 as best shown in FIG. 5.

Figure 6:
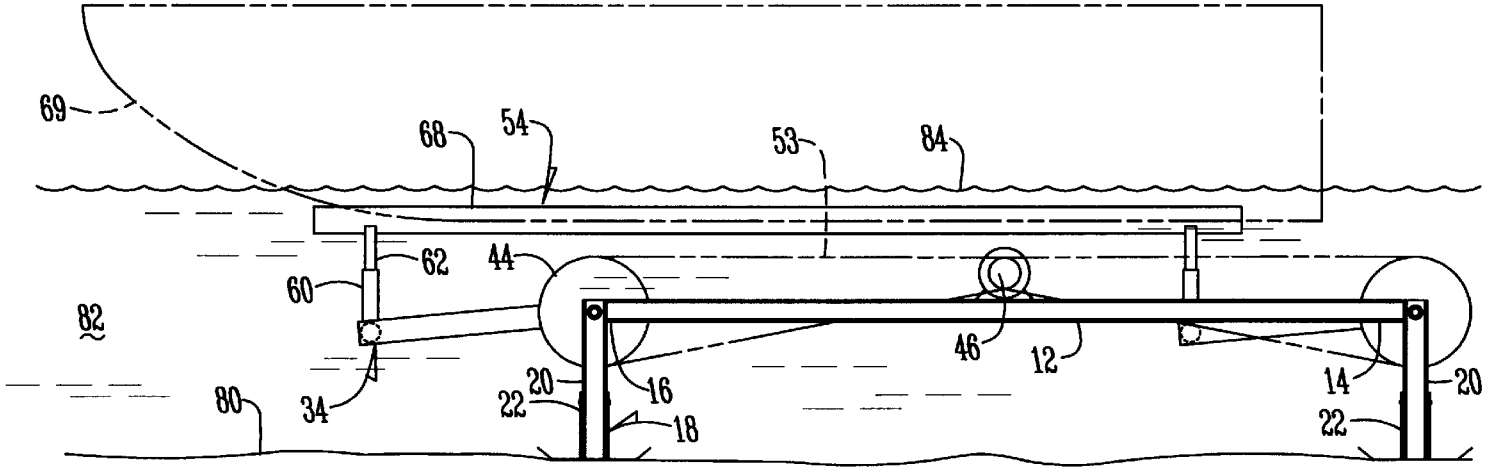
FIG. 6 is a view similar to that of FIG. 2 but shows a boat mounted on the apparatus.
Figure 7:
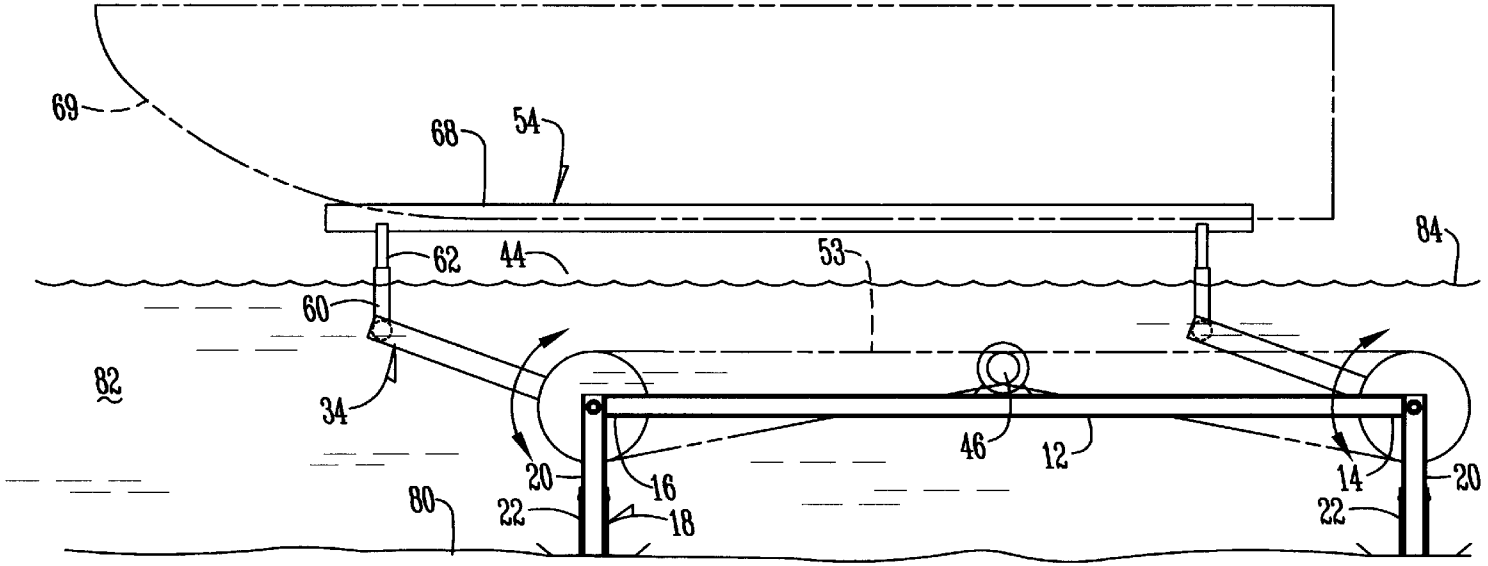
FIG. 7 is a view similar to FIG. 6 but shows the device of FIG. 6 in a subsequent stage of operation.

The numeral 80 designates an earthen support surface which can extend below and above the water 82 and the water surface 84. When used as a boat hoist, as shown in FIGS. 6 and 7, the walking hoist 10 is normally placed in the water adjacent a dock that extends out into the water away from the bank 81. In the position shown in FIG. 7, the boat 69 is in its "stored" position above the water surface 84. This is accomplished, as viewed in FIG. 7 by rotating the cranks 34 to approximately an "11 o'clock" position so that the load supporting frame 54 and the beams 68 are elevated above the water surface 84, thus lifting the boat 69 out of the water.

When it is desired to use the boat 69, the cranks 34 are operated by control switch 52 to cause the drive disks 44 to rotate in a clockwise direction to the level shown in FIG. 6 which lowers the load supporting frame 54 and permits the boat 69 to move into the water. When the frame 56 is lowered sufficiently, the boat will float and can be removed entirely from the frame 54. The boat 69 can be relocated on frame 54 by reversing the above process.

Figure 2:
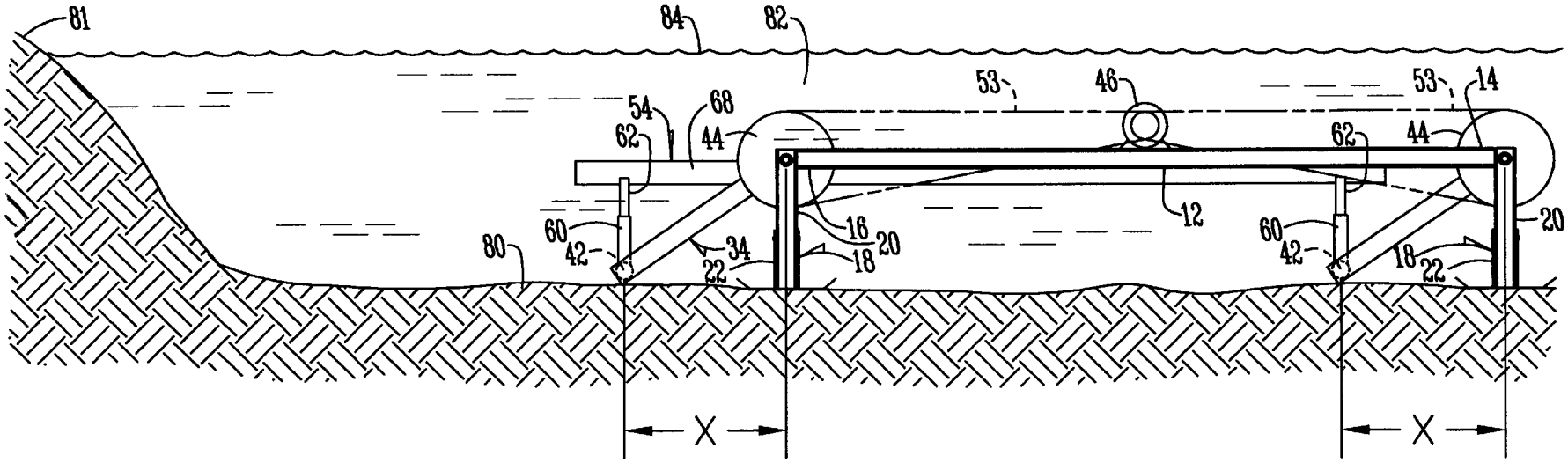
FIG. 2 is a side elevational view of the device of FIG. 1 emersed in a body of water adjacent the bank on the perimeter of the body of water.
Figure 3:
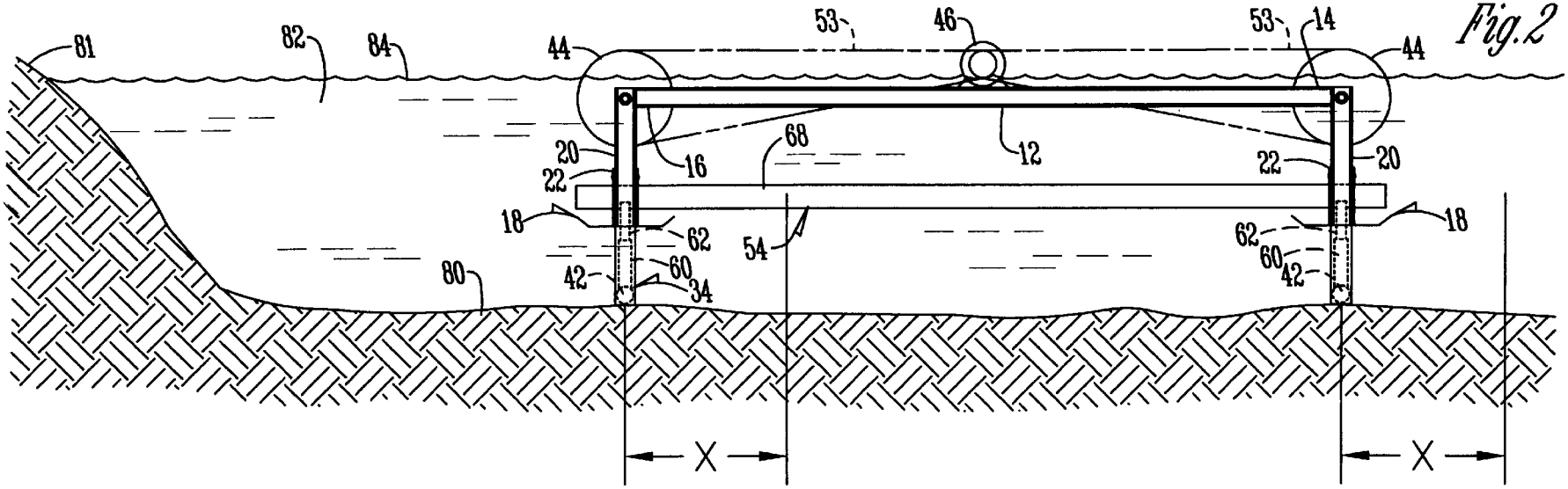
FIG. 3 is a view similar to that of FIG. 2 but shows the walking hoist in a sequential position of its operation.
Figure 4:
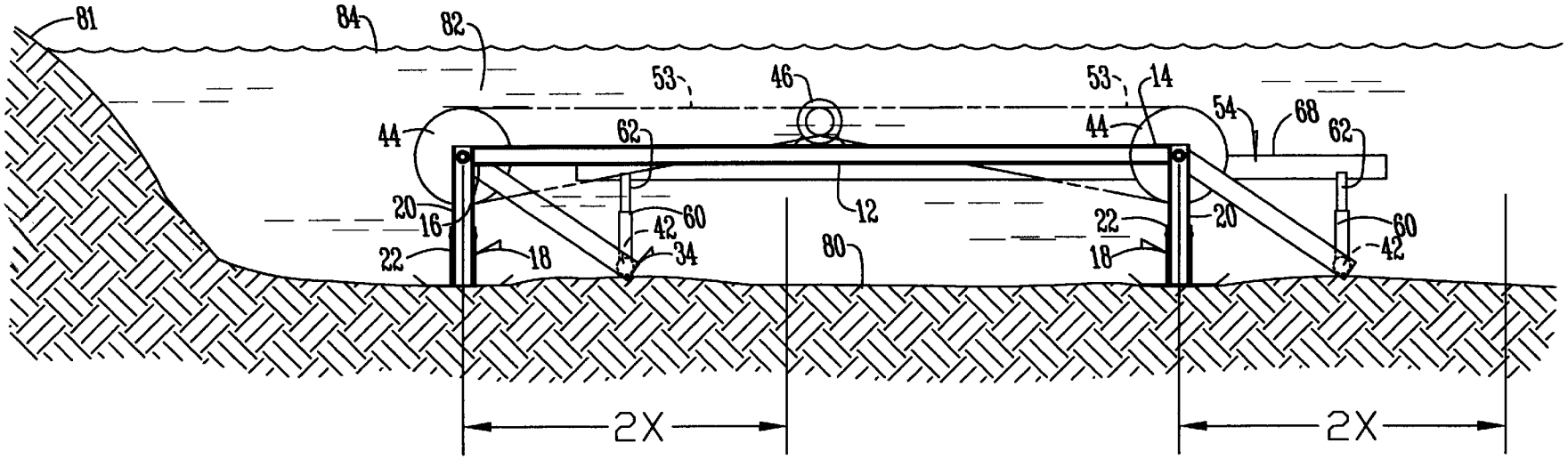
FIG. 4 is a view similar to FIG. 3 but shows the next step of operation.

FIGS. 2–4 illustrate the manner in which the walking hoist 10 can be moved longitudinally either along a supporting surface 80 or a supporting surface 80 which is below the water level.

With reference to FIG. 2, the walking hoist 10 is in the water 82 and is supported by legs 18 on the support surface 80. The cranks 34 and crank arms 38 extend downwardly and away from the legs 18. The horizontal shafts 42 of the crank arms 38 are substantially engaging the supporting surface 80. The longitudinal distance between the horizontal shafts 42 and the legs 18 is a distance "X" which in reality is a distance of 2 to 3 feet. When it is desired to move the walking hoist 10 towards the bank 81, the motor 46 is energized through switch 52 to cause the cranks to move in a counter clockwise direction from the position shown in FIG. 2 to the position shown in FIG. 3. In the position shown in FIG. 3, the legs 18, side members 12 and 14, and frame 54 have been lifted from the support surface 80. In the position of FIG. 3, the entire weight of the walking hoist 10 is supported by the cranks 34 and the horizontal shafts 42.

As the cranks 34 and crank arms 38 continue to be rotated in a counter clockwise direction, the apparatus shown in FIG. 3 is moved to the position shown in FIG. 4 whereupon the crank arms 38 have relinquished the support of the walking hoist 10 to the legs 18 which, in FIG. 4, have reengaged the support surface 80. In FIG. 4, it is seen that the crank arms 38 extend downwardly and away from the upper ends of legs 18 and no longer directly support the weight of the walking hoist. In moving the apparatus from the position of FIG. 3 to the position of FIG. 4, it is seen that the hoist has been moved longitudinally a distance of "2X" from its initial position towards bank 81. By repeating the foregoing process, the hoist 10 is moved another increment of 2X when the apparatus is moved from the position of FIG. 4 to the position of FIG. 5.

Ordinarily, the hoist 10 can walk its way completely out of the water if the bank 81 is not of a substantial incline. However, in the event that the rotating cranks 34 are unable to walk up a steeper bank, a post 78 can be imposed in the bank 81 and the cable 76 is secured to the post 78 and is secured to the drive yolk 70 in the manner described. Thus, when the crank on the end of the hoist 10 adjacent the bank rotates in a counter clockwise direction, the cable 76 wraps itself around the shaft 42 and the bite 77 of the yolk to provide a pulling force drawing the device by means of cable 76 toward the anchor post 78.

The walking hoist can be moved from the bank 81 back into the water 82 by reversing the direction of rotation of the cranks 34 through the actuation of switch 52 in order to place the walking hoist 10 back in the water 84. Obviously, the walking hoist of this invention can be used in other environments when a hoist is required in other than the boat environment.

From the foregoing, it is seen that the device of this invention will achieve at least all of its stated objectives.

What is claimed is:

1. A walking hoist, comprising, a pair of elongated parallel laterally spaced side members having opposite ends, a downwardly extending leg with upper and lower ends rigidly secured by its upper end to the ends of each side member, a pair of U-shaped crank members rotatably secured to and between adjacent ends of said side members, said U-shaped cranks each being comprised of a bearing member secured to the upper ends of said legs, crank arms secured to said bearings and extending radially therefrom in a parallel direction and terminating in an outer end, and a horizontal shaft extending between pairs of said crank arms at each end of said side members, said crank arms being longer than said legs, a circular drive disk rigidly operatively secured to the lower ends of a crank arm adjacent the opposite ends of at least one of said side members, a rotational power drive assembly operatively connected to said drive disks to rotate said drive disks in unison in the same direction, and a load supporting frame extending upwardly between the horizontal shafts of said cranks and being rotatably secured to said horizontal shafts, whereby, when said drive disks are rotated, said crank arms will sequentially engage a supporting surface supporting the lower ends of said legs to raise said legs therefrom and to simultaneously move said side members and said load supporting frame first upwardly and longitudinally, and thence downwardly and longitudinally until the lower ends of said legs reengage said supporting surface.

2. The device of claim 1 wherein said legs are length adjustable.

3. The device of the claim 1 wherein said drive disks are connected to said rotational device assembly by chains.

4. The device of claim 1 wherein said rotational drive assembly can be rotated in either a clockwise or counter clockwise direction.

5. The device of claim 1 wherein said load supporting frame is rigidly secured to the outer ends of said crank arms.

6. The device of claim 1 wherein said load supporting frame is rigid and is adjustably secured to the outer ends of said crank arms.

7. The device of claim 1 wherein said power drive assembly is a reversible electronic motor secured to one of said side members.

8. The device of claim 1 wherein an elongated drive yoke is rigidly secured to the horizontal shaft of one of said cranks for connection to an anchored line to facilitate the movement of said walking hoist up a steep incline.

9. The device of claim 1 wherein said load supporting frame includes spaced elongated support beams adapted to receive the hull of a boat.

10. The device of claim 1 wherein a horizontal support plate is secured to the lower end of each leg.

11. The device of claim 1 wherein said load supporting frame is of rigid construction and is rotatably secured to the outer ends of said crank arms to dwell in a substantially horizontal position regardless of the position of said crank arms.

* * * * *